United States Patent [19]

Hanlon

[11] Patent Number: 5,030,126

[45] Date of Patent: Jul. 9, 1991

[54] COUPLING RING RETAINER MECHANISM FOR ELECTRICAL CONNECTOR

[75] Inventor: Terrance W. Hanlon, Blaine, Minn.

[73] Assignee: RMS Company, Minneapolis, Minn.

[21] Appl. No.: 551,200

[22] Filed: Jul. 11, 1990

[51] Int. Cl.[5] ..... H01R 4/38

[52] U.S. Cl. ..... 439/320

[58] Field of Search ..... 439/310–317, 439/319–323

[56] References Cited

U.S. PATENT DOCUMENTS 3,808,580 4/1974 Johnson ..... 439/321

4,472,013 9/1984 Frear ..... 439/312

*Primary Examiner*—Joseph H. McGlynn

*Assistant Examiner*—Hien D. Vu

*Attorney, Agent, or Firm*—Dorsey & Whitney

[57] ABSTRACT

An electrical connector comprises first and second connector components, each component having a generally circular cross-section oriented perpendicular to a central axis that is common to both components. A rotatable coupling ring is retained on and substantially axially aligned with the first component. This coupling ring has a first end for engaging the second component and axially advancing the first component relative to the second component to urge the contacts of the first and second components into enngagement. The coupling ring also has a second end with a retainer groove that encircles the interior of the second end and that has a bearing surface in a plane substantially perpendicular to the common central axis of the first and second components. A retainer ring snugly engages the interior of the retainer groove. The retainer ring has a resiliently collapsible gap and also has an exterior retainer surface generally parallel to and engaging the bearing surface of the retainer groove. The retainer ring further has a formed lip extending from the exterior retainer surface of the retainer ring toward the common central axis and an interior retainer surface in the plane generally parallel to the exterior retainer surface but facing in the opposite direction. A thrust washer snugly engages the interior retainer surface and the formed lip of the retainer ring. A resilient washer interposed between the retainer ring and a flange on the first component urges the contacts of the first and second components together.

14 Claims, 4 Drawing Sheets

COUPLING RING RETAINER MECHANISM FOR ELECTRICAL CONNECTOR

BACKGROUND OF THE INVENTION

1. Field of the Invention

This invention relates generally to a two-part electrical connector for use in aircraft or other vibration-prone environments, and relates more particularly to a specially configured retainer ring and thrust washer used to hold a coupling ring that maintains the two connector components in their joined position.

2. Description of the Prior Art

U.S. Pat. Nos. 3,750,087 and 3,805,379 both show electrical connectors that include a plurality of mated pin and socket contacts held within insulating bodies that are, in turn, contained within protective shells. The respective pin and socket contacts are joined by insertion and a coupling ring is used to draw together and to hold together the two shells and their insulating bodies, thereby insuring adequate electrical contact between the pin and socket contacts and protecting the shells against separation that might be caused by vibration, physical shock or other stress and strain factors.

In U.S. Pat. Nos. 3,750,087 and 3,805,379, an externally threaded retainer ring is used in one connector component to hold in place a special spring washer and detent ring. The washer and ring together provide preloading forces to aid coupling and bottoming-out of the two connector components comprising the connector. While the use of a threaded retainer ring permits some adjustability, because the threaded retainer ring can be advanced a specified distance during assembly of a connector component, the use of a threaded retainer ring has certain disadvantages. For example, the threaded retainer ring is necessarily narrow, thus there is only a limited amount of material available for forming the external threads. This can lead to stripping of the threads that hold the retainer ring in place. In addition, forming the threads involves machining and increased costs compared to parts that do not need to be threaded. Finally, to hold a threaded retainer ring in place, U.S. Pat. Nos. 3,750,087 and 3,805,379 teach use of welding or staking. Epoxy has also been used in this type of connector. If welding or epoxy is used, it may be incorrectly placed and may be fractured when tools are used to grasp the connector. A staking process, on the other hand, tends to be expensive and makes the part look damaged. Accordingly, what is needed as an improvement over the prior art is a structure for holding the resilient means used in the coupling rings of two-part electrical connectors in such a way that a threaded retainer ring is unnecessary.

SUMMARY OF THE INVENTION

In accordance with the present invention, an electrical connector comprises first and second connector components, each component having a generally circular cross-section oriented perpendicular to a central axis that is common to both components. Each component further has contact means for engaging corresponding contact means of the other component. A rotatable coupling ring is retained on and substantially axially aligned with the first component. This coupling ring has a first end for engaging the second component and axially advancing said first component relative to said second component to urge the contact means of the first and second components into engagement. The coupling ring also has a second end with a retainer groove that encircles the interior of the second end and that has a bearing surface in a plane substantially perpendicular to the common central axis of the first and second components. A retainer ring snugly engages the interior of the retainer groove. The retainer ring has a resiliently collapsible gap and also has an exterior retainer surface generally parallel to and engaging the bearing surface of the retainer groove. The retainer ring further has a formed lip extending away from the exterior retainer surface of the retainer ring toward the common central axis and an interior retainer surface in the plane generally parallel to the exterior retainer surface but facing in the opposite direction. A thrust washer snugly engages the interior retainer surface and the formed lip of the retainer ring. Resilient means interposed between the retainer ring and a flange on the first component urges the contact means of the first and second components together when the rotatable coupling ring has advanced the first and second components and their respective contact means into engagement.

It is an object of the present invention to provide an electrical connector formed of two connector components that will be relatively inexpensive to manufacture.

Another object of the present invention is to provide a coupling ring for an electrical connector that is easily assembled and will have a high degree of reliability during an extended useful life in environments where high shock forces and vibration are present.

A further object of the present invention is to provide a coupling ring retainer ring for a two-part electrical connector that has greater resistance to shearing than prior threaded retainer rings.

A still further object of the present invention is to provide a retainer ring for the coupling ring component of an electrical connector that does not require adjustment during assembly.

These and other objectives will become apparent from the following description of the preferred embodiment.

DESCRIPTION OF THE PREFERRED EMBODIMENT

Figure 1:
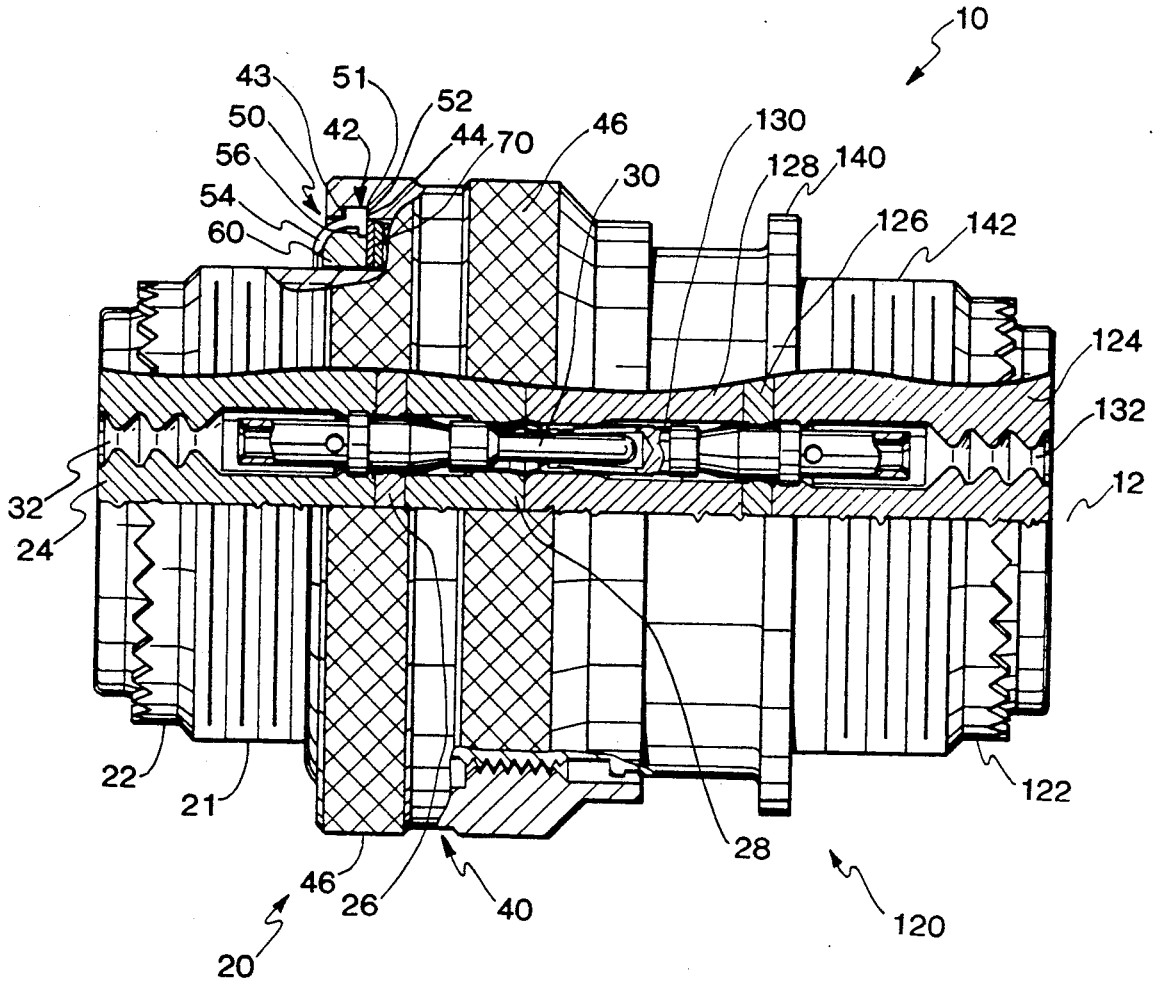
FIG. 1 is side elevational view of the electrical connector of the present invention when the parts are fully coupled together, two portions thereof being broken away in order to show to better advantage the construction of the contacts and the retainer ring construction.

FIG. 1 shows a connector 10 constructed in accordance with the present invention. This connector 10 is made by joining a first connector component 20 (shown on the left hand side of FIG. 1) and a second connector component 120 (shown on the right hand side of FIG. 1). Retained on the first component 20 is a rotatable coupling ring 40 that is used to join the two components 20, 120 together. The first and second components 20, 120 and the coupling ring 40 share a common central axis 12, and each has a generally circular cross-section.

The second component 120 has as its exterior shell 122 of metal or other rigid material. Contained and supported within the shell 122 are an insulator grommet 124, a rigid dielectric contact retainer 126 and a dielectric contact holder block 128. These members 124, 126, 128 are all fixedly retained in the shell 122 and encompass and hold in place a plurality of socket contacts 130 (contact means), one of which is shown as an example in FIG. 1. The number of such contact means is arbitrary and depends on the number of wires to be joined. Wire passage 132 is used to lead a wire (not shown) into electrical contact with socket contact 130.

Also part of the second component 120 is a mounting flange 140 and a set of external threads 142, both of which are formed as part of the exterior of the shell 122. The mounting flange 140 is usually used to mount the second component on a planar surface (not shown). The external thread 142 is used for the mounting of accessory hardware (not shown).

The first connector component 20 comprises a rigid shell 22 enclosing an insulator grommet 24, a rigid dielectric contact retainer 26, and a dielectric contact holder block 28. These members 24, 26, 28 are all fixedly retained in the shell 22 and encompass and hold in place a plurality of pin contacts 30 (contact means) that are received in the socket contacts 130 of the second component 120. Also a part of the first component 20 is a set of external threads 21 similar to the external threads 142 on the second component 120.

The coupling ring 40 that surrounds the right hand portion of the first connector component 20 has two circumferential knurled surfaces 46 surrounding it. The coupling ring 40 is retained on the first connector component 20 by means of a combination of a retainer ring 50 and a thrust washer 60 coacting with resilient means 70 and a flange 23 (see FIG. 2) on the first component 20. The interior surface of the first or right hand end of the coupling ring 40 has internal threads 48 for engaging external threads on that part of the shell 122 covered by the coupling ring 40 in FIG. 1. The interior surface of the second or left hand end of coupling ring 40 includes a retainer groove 42 that is machined in and encircles the inner circumference of the coupling ring 40. This retainer groove 42 has a channel cross section, with opposed, parallel bearing surfaces 43, 44, each of which lies in a plane generally perpendicular to the common central axis 12 of the connector 10. Captured snugly within the retainer groove 42 is the exterior ridge 51 (see FIG. 6) of a retainer ring 50. The retainer ring 50 has an exterior retainer surface 52 (oriented generally parallel to bearing surfaces 43, 44), which lies adjacent to resilient means 70, as explained in greater detail below. Retainer ring 50 also has an interior retainer surface 56 that is parallel to the exterior retainer surface 52 but faces the opposite direction. When the retainer ring 50 is installed in its operative position (as in FIGS. 1, 2), it has a formed lip 54 that curves downwardly from the ridge 51 captured in the retainer groove 42.

Enclosed and captured by the formed lip 54 and the internal retainer surface 56 at the internal circumference of the retainer ring 50 is a thrust washer 60, having an external circumferential surface that matches the interior of the retainer ring 50. As can be seen, capturing of the thrust washer 60 within the retainer ring 50 and capturing of the retainer ring 50 within the retainer groove 42 permits these two together to resist the resilient means 70 abutting them. How this capture is accomplished in the assembly of the first component 20 and the coupling ring 40 will now be explained.

Figure 6:
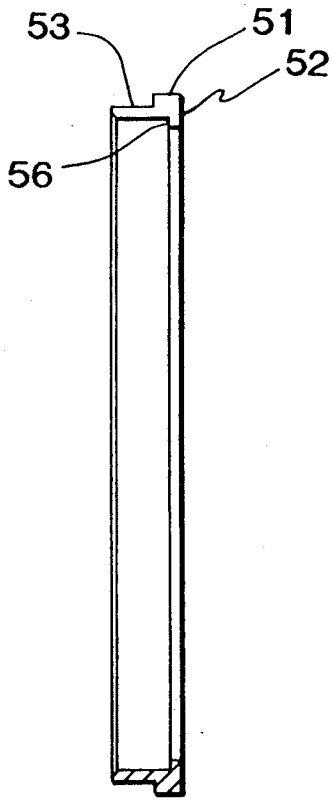
FIG. 6 is a cross sectional view of the retainer ring of FIG. 5, taken along the line 6—6 in FIG. 5.
Figure 5:
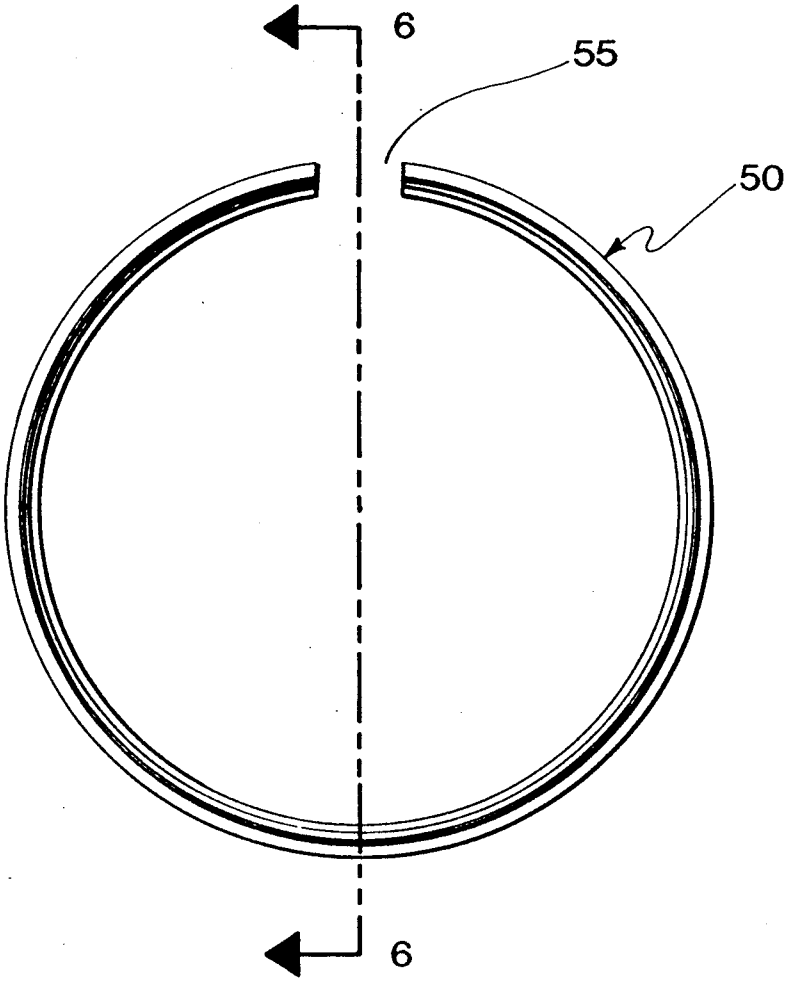
FIG. 5 is a front elevational view of the retainer ring used in the present invention.

As best seen in FIGS. 5 and 6, the retainer ring 50 has a gap 55 in its circumference. The retainer ring 50 is formed with an exterior ridge 51 and an exterior retainer surface 52 that is essentially parallel to the plane of the retainer ring 50 itself. In addition, the retainer ring 50 has a lip 53 that, before its installation, extends from the exterior ridge 51 perpendicular to and away from the exterior retainer surface 52. In addition, the retainer ring 50 has an interior retainer surface 56 that is parallel to the exterior retainer surface 52. The retainer ring 50 is made of a resilient metal or other material so that it can be temporarily deformed or collapsed by bringing together the ends at gap 55.

Figure 4:
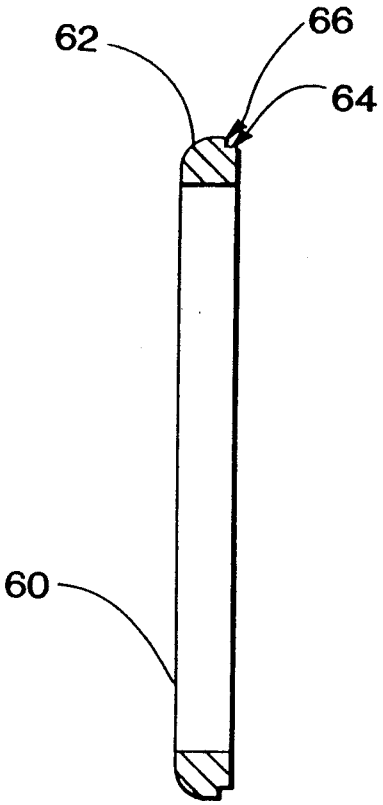
FIG. 4 is a cross sectional view of the thrust washer used in the present invention, taken along line 4—4 in FIG. 3.
Figure 3:
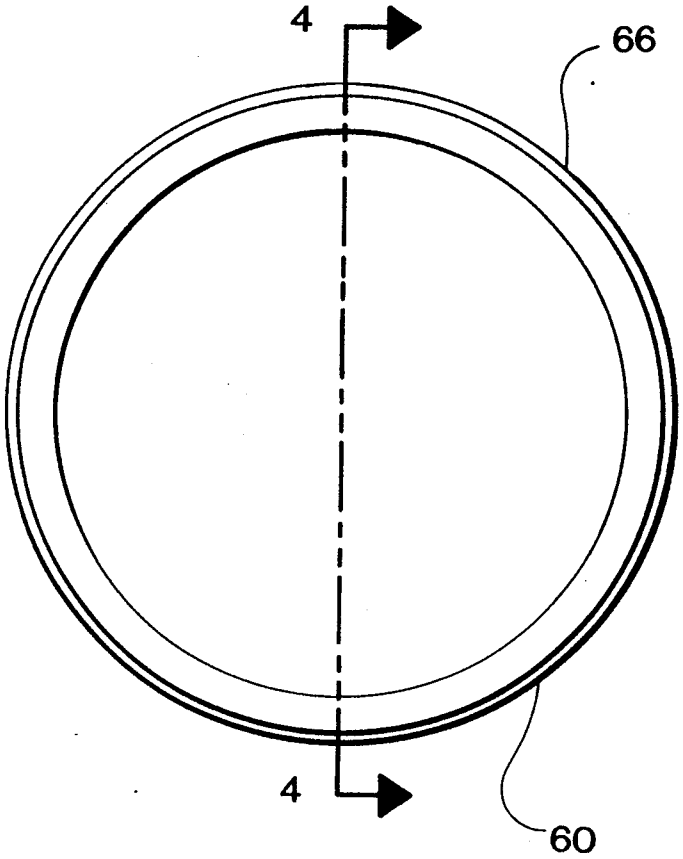
FIG. 3 is a front elevational view of the thrust washer used in the present invention.

Turning to FIGS. 3 and 4, the annular thrust washer 60, has a curved external surface 62 with a radius approximately equal to the thickness of the thrust washer 60. In addition, the thrust washer 60 has a notch 64 along its outer circumference that includes an abutting surface 66 oriented parallel to the plane of the thrust washer 60 as a whole. The thrust washer 60 has no gap as in the retainer ring 50.

Figure 2:
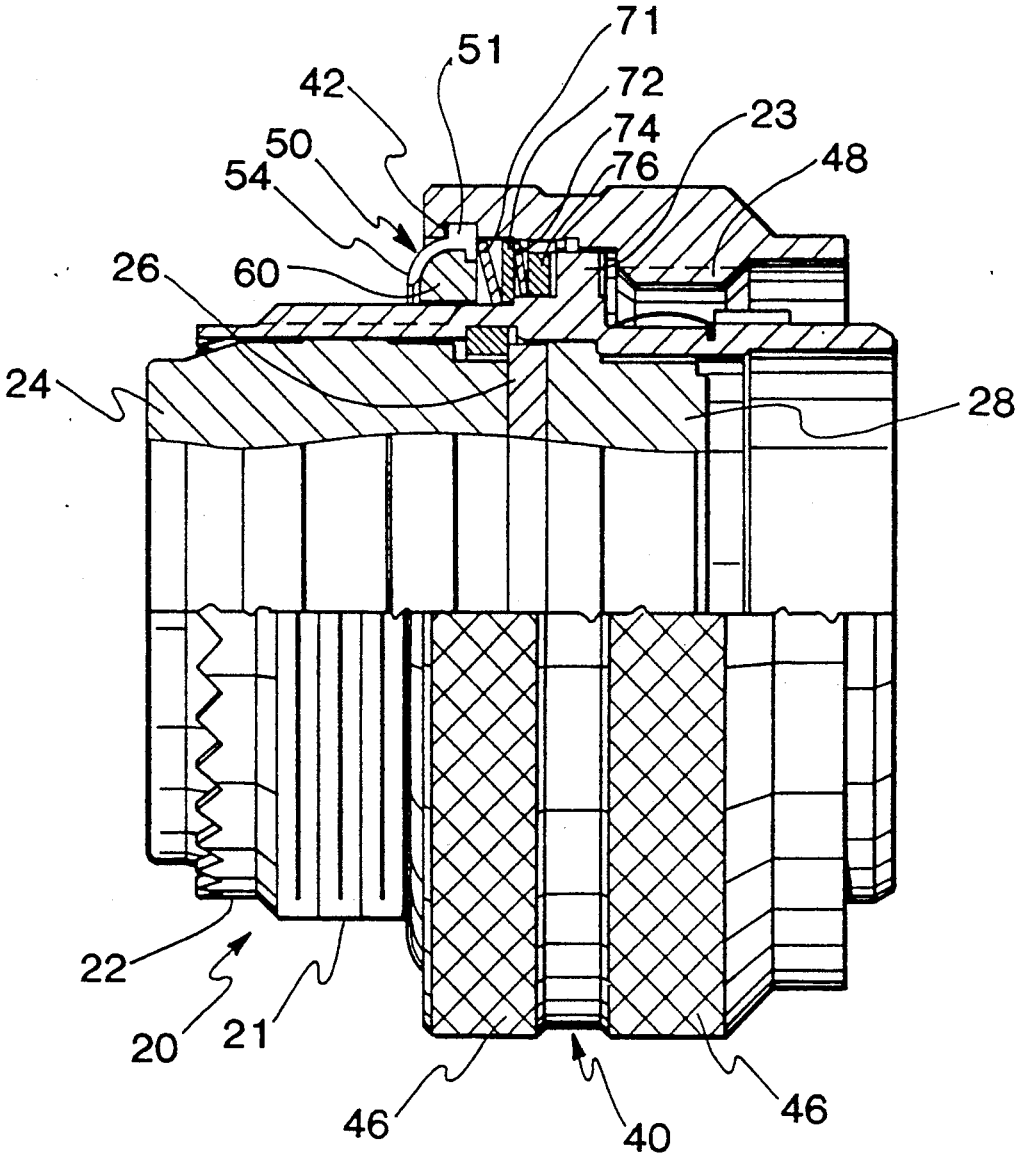
FIG. 2 is a side elevational view of the left hand component of the electrical connector shown in FIG. 1, with a portion broken away in order to show the manner in which the coupling ring is retained on this component.

Turning now to FIGS. 1 and 2, use of the retainer ring 50 and thrust washer 60 in a method of assembly of the first connector component 20 will be explained. As can be seen, the cross-sectional configuration of the coupling ring 40 is such that its second end can be inserted over the right hand side of the first component 20 until the region containing internal threads 48 begins to abut the flange 23 on the first component 20. Once in this position, the following components are inserted from the left side (as seen in FIG. 2) of the flange 23 in the following order: a ring detent 76, a detent spring 74, a spacer 72, and a belleville washer 71. Once these have been inserted, the retainer ring 50 (with its lip 53 unformed, as in FIG. 6) is radially compressed to eliminate its gap 55 and it is inserted in the retainer groove 42, where it expands back to essentially the shape it has in FIG. 5, snugly occupying the retainer groove 42. Now the thrust washer 60 can be inserted beneath the lip 53. At this point the exterior circumference of the belleville washer 71 bears against the exterior retainer surface 52 of the retainer ring 50 (see FIG. 2). To complete assembly, the lip 53 is mechanically formed radially inwardly towards the common central axis 12 and around thrust washer 60 to capture the thrust washer 60 in position. Because the thrust washer 60 is sized so that it fits snugly inside the retainer ring 50 when the retainer ring 50 has sprung back from its compressed configuration (in which resiliently collapsible gap 55 is decreased in size), the gap 55 can no longer be collapsed. Retainer ring 50 is fixed in retainer groove 42 (unless and until the thrust washer 60 is removed). The end result is that the retainer ring 50 and thrust washer 60 act as one solid mass, making it almost impossible for normal stress and strain to disassemble the coupling ring 40 from the shell 22.

When the first component 20 and coupling ring 40 are not joined to the second component 120 (as seen in FIG. 2), the resilient means 70 formed by the belleville washer 71, the spacer 72, the detent spring 74 and the ring detent 76 is not compressed. When the first component 20 and the second component 120 are brought together with the pin contacts 30 being inserted into the socket contacts 130, the first end of coupling ring 40 engages the second connector component 120. In the preferred embodiment, the coupling ring 40 has internal threads 48 that engage corresponding threads on the exterior surface of shell 122 of the second component 120. When these threads are engaged and the coupling ring 40 turned, the second component 120 axially advances into the coupling ring 40. When dielectric contact holder blocks 28, 128 bottom out against each other and the coupling ring 40 continues to advance, the resilient means 70 are compressed. This compression helps insure that the pin contacts 30 and socket contacts 130 remain in engagement and that the coupling ring 40 remains in place on the shell 22, despite extremely high forces exerted through the coupling cycle and later by shock, vibration and other environmental stresses.

The forces exerted by the outer periphery of belleville washer 71 on exterior retainer surface 52 are transmitted into the retainer groove 42. Thus, little or no significant force is borne by the formed lip 54 or any other part of the thrust washer 60. In contrast to a structure using a threaded retainer ring, the threads of which may be stripped, the exterior retainer surface 52 and the bearing surfaces 43, 44 of the retainer groove 42 are all substantially perpendicular to the common central axis 12. Thus, for the tightened coupling ring 40 to move, one of these surfaces must be sheared off.

It will be apparent to those skilled in the art that certain variations of the above described preferred embodiment are possible. For example, it will be clear that instead of using threads to connect the coupling ring 40 and second connector component 120, another inclined plane type coupling, such as the bayonet-type connection shown in U.S. Pat. No. 3,750,087 could be used. Also, it will be clear that the design is applicable not only for electrical connectors but for almost any other form of connector in which a resilient means is compressed when connector pieces are brought together to help reinforce the connection forces. Accordingly, the present invention is not limited to the preferred embodiment described above, but rather it is determined by the scope of the claims that follow below.

What is desired to be patented and protected by Letters Patent is:

1. A connector comprising:

first and second connector components, each component having a generally circular cross-section oriented perpendicular to a central axis common to both components and having contacts means for engaging corresponding contact means of the other component;

a rotatable coupling ring retained on and substantially axially aligned with said first component, said coupling ring having a first end for engaging said second component and axially advancing said first component relative to said second component to urge said contact means of the first and second components into engagement and a second end with a retainer groove adjacent said second end and encircling its interior, said retainer groove having two parallel bearing surfaces, each in a plane substantially perpendicular to the common central axis of said first and second components;

a retainer ring engaging the retainer groove, said retainer ring having a resiliently collapsible gap and also having an exterior retainer surface generally parallel to and engaging a bearing surface of the retainer groove, said retainer ring further having a formed lip extending away from said exterior retainer surface of the retainer ring and toward the common central axis and an interior retainer surface in a plane generally parallel to the exterior retainer surface but facing in the opposite direction;

a thrust washer engaging the interior retainer surface and the formed lip of said retainer ring; and resilient means for urging the contact means of the first and second components together when the rotatable coupling ring has advanced the first and second components and their respective contact means into engagement, said resilient means being interposed between said retainer ring and said first component.

2. The connector as recited in claim 1 wherein the rotatable coupling ring engages the second component with an inclined plane type coupling mechanism.

3. The connector as recited in claim 1 wherein the rotatable coupling ring engages the second component with a screw type coupling mechanism.

4. The connector as recited in claim 1 wherein the retainer groove has a channel cross section with substantially parallel, opposed interior side surfaces forming its bearing surfaces.

5. The connector as recited in claim 1 wherein the contact means are electrical contact means.

6. The connector as recited in claim 1 wherein the resilient means comprises a belleville washer.

7. The connector as recited in claim 6 wherein the outer periphery of the belleville washer bears against the retainer ring.

8. The connector as recited in claim 6 wherein the outer periphery of the belleville washer bears against the retainer ring without exerting any significant force on the thrust washer.

9. The connector as recited in claim 6 wherein the belleville washer is interposed between the retainer ring and a flange of said first component that faces the holding surface of the retainer groove.

10. The connector as recited in claim 1 wherein the thrust washer has one substantially flat side surface and a curved opposing side surface.

11. The connector as recited in claim 10 wherein the formed lip of the retainer ring follows the curved side surface of the thrust washer.

12. A method of assembling a connector comprised of:

first and second components to be connected in alignment on a common central axis, each having contact means for engaging the corresponding contact means of the other component;

a rotatable coupling ring having an internal retainer groove and adapted to be retained on said first component for engaging said second component and axially advancing said second component relative to said first component;

a gapped, resiliently collapsible retainer ring with a formable lip and exterior and interior retainer surfaces;

a thrust washer sized to fit snugly inside the retainer ring when the retainer ring is not collapsed; and resilient means for urging the contact means of the first and second components into secure engagement, the method comprising the steps of:

positioning said rotatable coupling ring around said first component in substantial alignment with said common axis;

positioning the resilient means within said coupling ring at a position interior of the retainer groove and interposed between said retainer groove and a bearing flange of said first component;

resiliently collapsing said retainer ring and placing it into said retainer groove of said rotatable coupling ring so that it resiliently expands into said retainer groove with its exterior retainer surface adjacent to said resilient means;

placing said thrust washer inside the retainer ring so that it engages the interior retainer surface of said retainer ring; and deforming the lip portion of said retainer ring toward said common axis to capture said thrust washer between said lip portion and the interior retainer surface of said retainer ring.

13. The method as recited in claim 12 wherein the thrust washer has one curved side surface and the step of forming the lip portion of said retainer ring comprises press-forming it to conform to the curved side surface of the retainer ring.

14. The method as recited in claim 12 wherein said contact means are electrical contact means.

* * * * *